US005816579A

United States Patent [19]

Broussard et al.

[11] Patent Number: 5,816,579

[45] Date of Patent: Oct. 6, 1998

[54] THREE DIMENSIONAL MANNEQUIN FOR MARKSMANSHIP AND WEAPONS TRAINING PRACTICE

[75] Inventors: David N. Broussard; Danny Ray Smith; Clinton H. Evans, all of Coryell County, Tex.

[73] Assignee: Medical Plastics Laboratory, Inc., Gatesville, Tex.

[21] Appl. No.: 834,623

[22] Filed: Apr. 14, 1997

[51] Int. Cl.[6] ..... F41J 3/00

[52] U.S. Cl. ..... 273/408; 273/407; 273/DIG. 5

[58] Field of Search ..... 273/403, 404, 273/405, 406, 407, 408, 409, 348, 390, DIG. 5; 473/600

[56] References Cited

U.S. PATENT DOCUMENTS 4,373,733 2/1983 Smith, Jr. ..... 273/381
4,725,058 2/1988 Molitor ..... 473/600
5,498,001 3/1996 Franks et al. ..... 273/403
5,676,378 10/1997 West ..... 273/390

*Primary Examiner*—William H. Grieb
*Attorney, Agent, or Firm*—Locke Purnell Rain Harrell

[57] ABSTRACT

A marksmanship and weapons training mannequin is disclosed which employs a lifesize mannequin torso in place of the traditional paper targets. The mannequin torso provides more realistic training and provides anatomically correct aiming references. The mannequin is made from an outer skin filled with a flexible interior foam. The outer skin is formed from a flexible material which returns to its original shape even after a projectile passes through it. This resilience allows the mannequin to absorb thousands of rounds and still remain useful as a training tool. Further, the three dimensional nature of the mannequin allows training in realistic circumstances and from angles not possible with paper or hard plastic targets.

19 Claims, 3 Drawing Sheets

THREE DIMENSIONAL MANNEQUIN FOR MARKSMANSHIP AND WEAPONS TRAINING PRACTICE

This invention relates to targets for use in marksmanship and weapons practice. More particularly, the invention relates to a three dimensional anatomically correct mannequin target system with life like features which is used in place of traditional two dimensional paper or plastic targets.

BACKGROUND OF THE INVENTION

Traditional targets for weapons practice have been paper or metal pictures or silhouettes. While these traditional targets are very good tools in marksmanship or weapons practice, they have fundamental limitations in their applicability to training for real life circumstances. For example, traditional targets cannot be used to simulate traffic stops for state troopers and police officers, one of the most potentially volatile situations according to law enforcement officers. Similarly, traditional targets are of limited use for S.W.A.T. and military snipers who must practice engaging targets from strange angles which cannot be simulated by paper targets. Further, most traditional targets particularly paper or hard plastic to targets must be replaced frequently, as they will accept only a limited number of rounds.

While three dimensional mannequins have existed for years, current mannequins are unsuitable for marksmanship and weapons practice for a variety of reasons. Most traditional mannequins are made from a hard plastic material. Hard plastic mannequins are unacceptable for weapons practice as they would shatter when struck by projectiles and could result in dangerous ricochets. Additionally, the hard nature of the mannequins would severely limit their effective life as a training tool. The hard plastic mannequin would result in significant holes when struck, the number of holes limiting the rounds that could be shot into the mannequin before it would become useless as a training tool.

SUMMARY OF THE INVENTION

In accordance with the present invention, a marksmanship and weapons training mannequin is provided which can be struck thousands of times by projectiles or sharp instruments before needing replacement. The three dimensional mannequin includes an outer skin formed in the shape of a human being from a durable flexible material having a Shore 'A' durometer rating between 40 and 65. The outer skin is filled with a foam interior which has a free rise density between about 2.8 and 6.5 lbs. per cubic foot. A shatter-proof pole can be inserted into the mannequin to aid in mounting the mannequin for training. In the preferred embodiment, the outer skin is formed from a mixture of polyvinyl chloride and plasticizer where the plasticizer is 75–160 parts per hundred resin by weight. This results in a mixture that is about 9 to 10 lbs. of plasticizer per gallon of polyvinyl chloride, or about 30% to 60% plasticizer by volume. The foam interior is preferably formed from a flexible polyurethane, and the internal pole is formed from a medium density polyethylene with a melt index between 3.5 and 5.0.

The flexible material of the outer shell is designed to return substantially to its original shape after allowing a projectile to pass therethrough. The flexible material of the outer skin has an elongation percentage between 200 and 300. Similarly, the foam interior can be penetrated by the projectile without serious change in its structure or shape. A base and frame can be included which using in combination with the internal pole, allows the marksmanship and weapons training mannequin to be positioned for training. The base includes a weighted foundation and anchoring mechanisms. The frame inserts into the anchoring mechanisms and fits telescopically, with the internal pole allowing the height of the mannequin to be adjusted by use of height adjustment holes and an anchoring pin. The weapons training mannequin can be rotated on the frame to enable training with the mannequin at any angle to the trainee.

The features and advantages of the invention will become more readily understood from the following detailed description taken in conjunction with the appended claims and attached drawing wherein:

DESCRIPTION OF THE PREFERRED EMBODIMENTS

Figure 1:
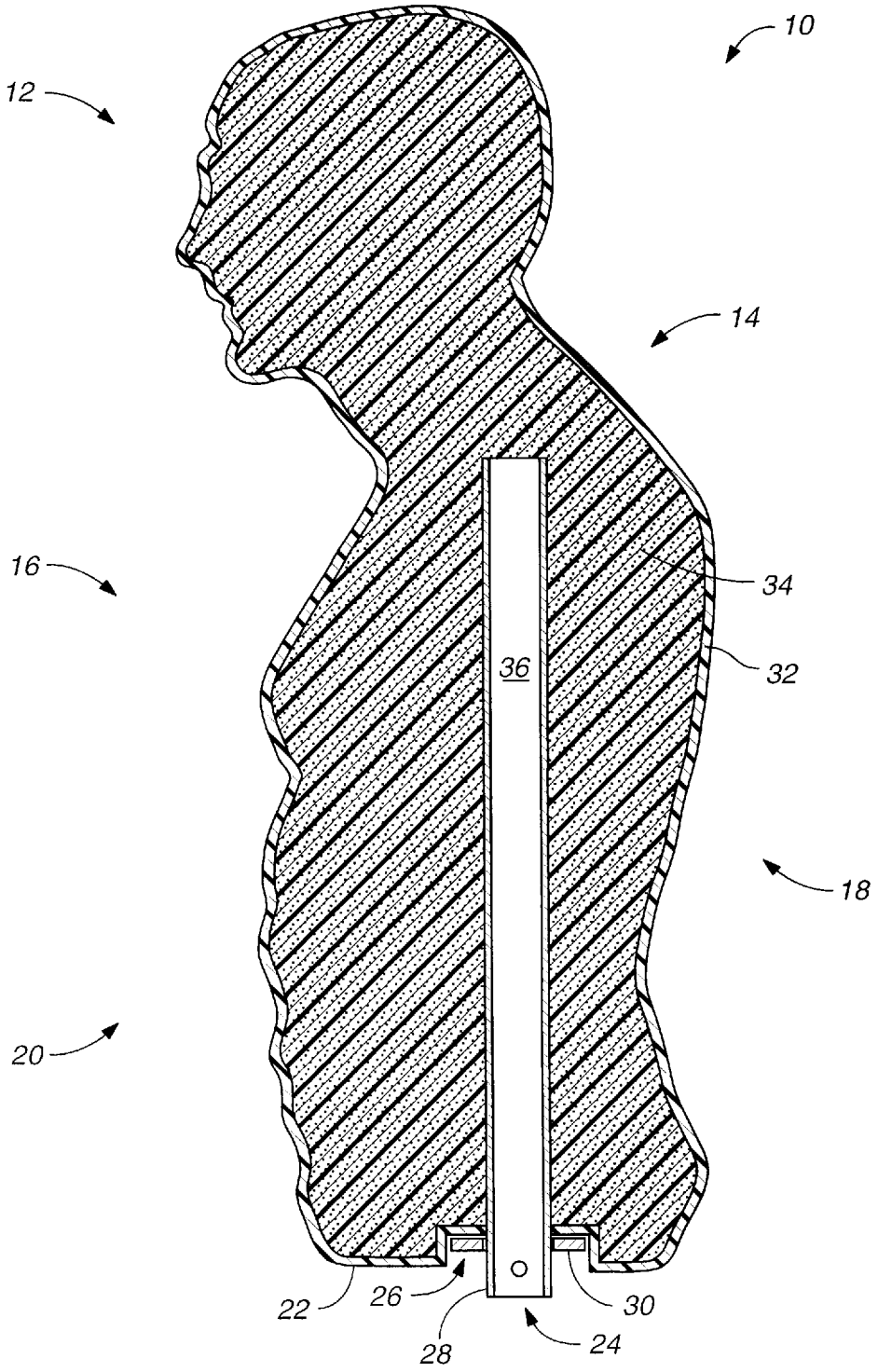
FIG. 1 is a sectional side view of the weapons training mannequin of the present invention.

Referring now to FIG. 1, the preferred embodiment of marksmanship and weapons training mannequin 10 is shown in a sectional side view. In the preferred embodiment, mannequin 10 is in the form of a human torso having head 12, shoulders 14, chest 16, back 18 and midsection 20. Underside 22 of mannequin 10 is preferably formed with aperture 24 in the center of recess 26. Aperture 24 allows pole 28, or other standing device, to be inserted into mannequin 10. Retainer ring 30 can be used to hold mannequin 10 on pole 28.

Forming mannequin 10 in the shape of a three dimensional human torso allows for types of marksmanship and weapons training not available before. While paper targets are available that allow target practice for direct frontal shots, these paper targets cannot be used to practice side angle shots or elevated shots. Mannequin 10, on the other hand, allows for training and target practice from any angle It is anatomically correct, not only from the front, but also from the sides, back and even the top. Mannequin 10 can be used by police officers to practice realistic approaches to traffic stops. Also, mannequin 10 is ideal for simulating anti-terrorist scenarios, and for training snipers who often must shoot from strange angles and from elevated positions. The three dimensional nature of mannequin 10 also allows for other applications including bayonet training by the military using an anatomically correct target.

At least as important as the three dimensional and anatomically correct nature of mannequin 10 are the materials and construction which allow mannequin 10 to provide life like reaction to impacts and to absorb literally thousands of rounds from any angle. Mannequin 10 is formed essentially by skin 32 and foam interior 34. Skin 32 is formed from a flexible material which allows a projectile to pass through it without destroying the integrity of skin 32. Skin 32 returns to its original position after being penetrated by the projectile, leaving only a small slit in skin 32. After passing through skin 32, the projectile then enters foam interior 34 and either remains in foam interior 34 or exits through the other side of skin 32 again leaving only a small hole or slit. The ability of outer skin 32 to return to its original shape, after allowing the projectile to pass through it, is what allows mannequin 10 to be a useful target which can take hits from thousands of rounds before replacement and eliminates the potential ricochets. Pole 28 is also formed from a shatter-proof material to prevent rounds that happen to strike it ricocheting off of or breaking pole 28. Forming skin 32 from a flexible material and filling it with a foam interior allows mannequin 10 to react realistically to live fire impacts. This allows trainees to know immediately that they have hit the target.

To obtain the desired resilience, skin 32 is formed from a material that has a hardness, as measured by a Shore 'A' durometer rating, from about 40 to 65. This should result in the material of skin 32 having an elongation percentage between 200 and 300, the elongation percentage being the amount the material can be stretched and still return to its original shape. Foam interior 34 allows skin 32 to maintain the form of a human torso and should have a density between about 2.8 and 6.5 lbs. per cubic foot.

In the preferred embodiment, skin 32 is formed from a mixture of polyvinyl chloride and a plasticizer. The mixture is from about 75 to 160 parts per hundred resin by weight. This results in the plasticizer being about 30% to 60% of the total mixture by volume, or about 9 to 10 lbs. of plasticizer per gallon of polyvinyl chloride. To form skin 32, the mixture of polyvinyl chloride and plasticizer is molded using a rotational-molding process to the desired thickness. Once skin 32 is formed, foam interior 34, which in the preferred embodiment is flexible polyurethane, is injected into skin 32 to give mannequin 10 a life like shape and feel. During the injection of foam interior 34, a form is positioned inside skin 32 to provide cavity 36 into which pole 28 will be inserted. Pole 28 in the preferred embodiment is made from medium density polyethylene with a melt index from 3.5 to 5.0. Any shape or size form may be used in creating cavity 36 to allow mannequin 10 to be used with existing target systems already installed at shooting ranges instead of pole 28.

Figure 2:
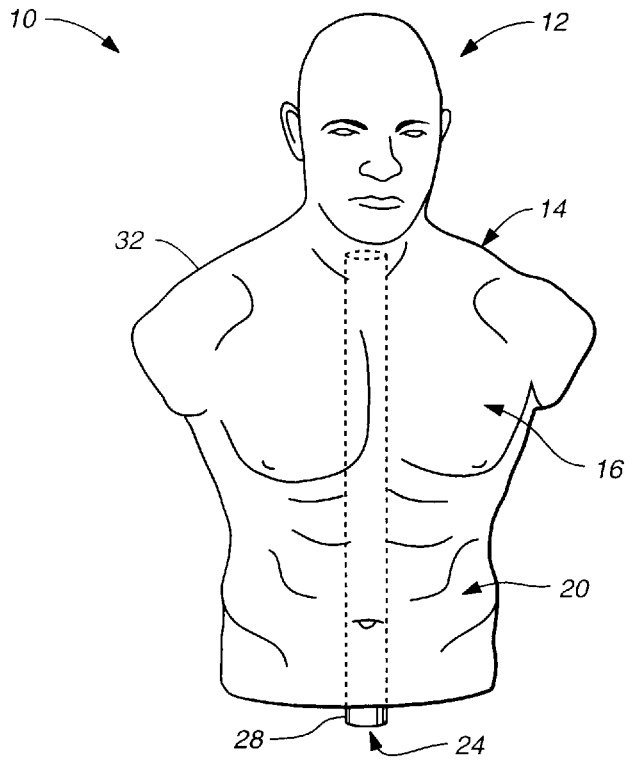
FIG. 2 is a frontal view of the weapons training mannequin of FIG. 1.
Figure 3:
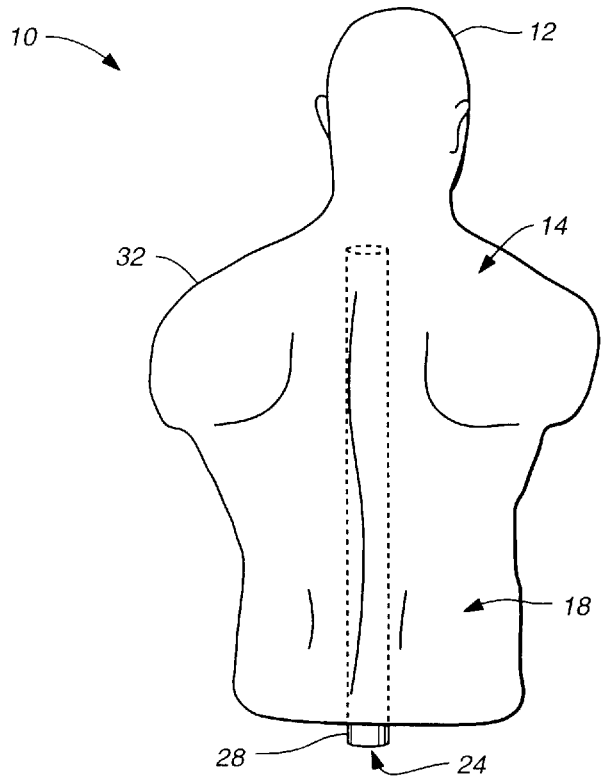
FIG. 3 is a back view of the weapons training mannequin of FIG. 1.

FIGS. 2 and 3 show a frontal view and a rear view, respectively, of mannequin 10 with pole 28 shown in phantom. FIGS. 2 and 3 show the realistic three dimensional nature of mannequin 10. Again, mannequin 10, in the preferred embodiment, includes head 12, shoulders 14, chest 16, back 18, and midsection 20 to provide realistic anatomically correct reference points for marksmanship and weapons training. Although mannequin 10 only includes a torso, the present invention could easily be formed with arms, and or with hips and legs to form a full human body.

Figure 4:
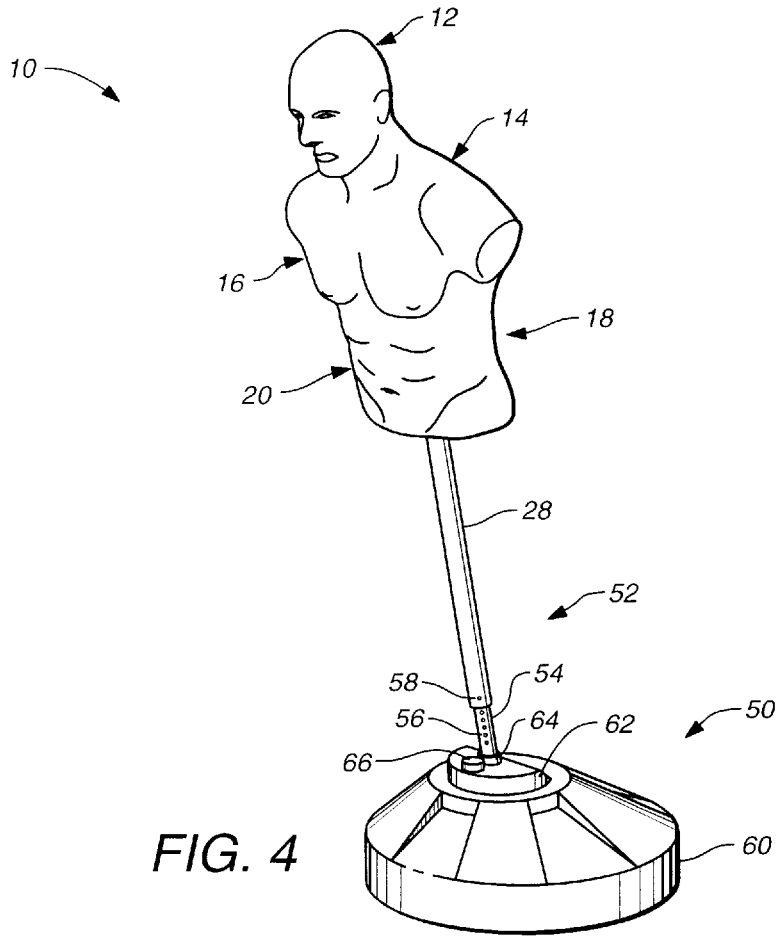
FIG. 4 is a perspective view of the weapons training mannequin torso attached to a frame which is mounted in a base in the angled forward position.
Figure 5:
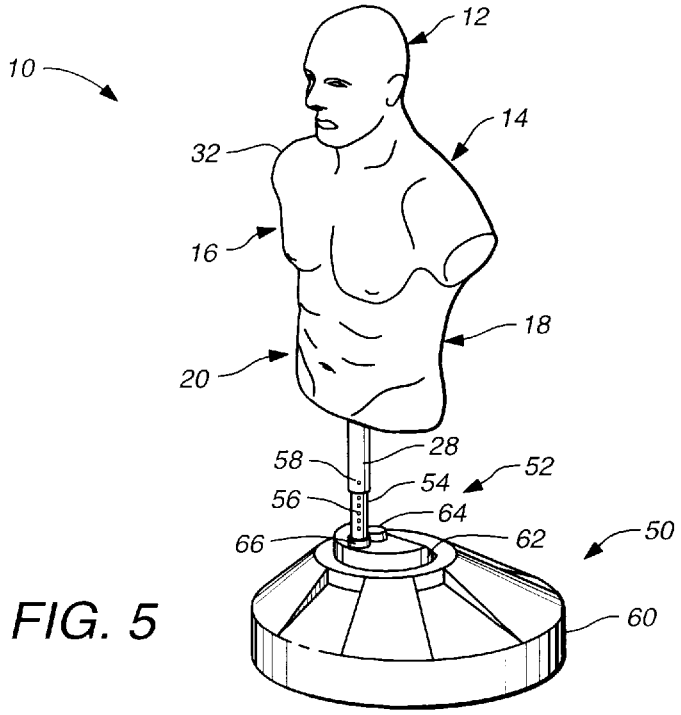
FIG. 5 is a perspective view of a weapons training mannequin torso attached to a frame which is mounted in a base in the vertical position.

Referring now to FIGS. 4 and 5, mannequin 10 can be used with base 50 and frame 52 to hold mannequin 10 in a fixed position at almost any angle to the trainee. As stated, mannequin 10 incorporates human features including head 12, shoulders 14, chest 16, and midsection 20 to provide anatomical reference points which can be used by the person being trained. These anatomical reference points provide for much more realistic training than do standard paper targets. Mannequin 10 also provides realistic anatomical reference points from the sides, back and top allowing training from any angle. A type of training not possible with paper targets.

When using mannequin 10 on base 50, pole 28, or other standing device, is inserted into aperture 24 on the underside of mannequin 10 to secure frame 52 to mannequin 10. Frame 52 is used to hold mannequin 10 substantially above base 50. In the preferred embodiment, frame 52 is formed by frame pole 54 which telescopes into pole 28. In one embodiment, frame pole 54 has outer dimensions that correspond to the inner dimensions of pole 28 such that pole 28 slides over frame pole 54 allowing the height of frame 52 to be adjusted while still ensuring that frame 52 is rigid. Height adjustment holes 56 are provided in pole 28 or frame pole 54 and used in conjunction with pin element 58 to fix frame 52 at the desired height. The adjustable height of frame 52 allows mannequin 10 to simulate persons of varying height for training purposes. Ideally, frame 52 is adjustable to the extent that persons ranging in height from as little as five feet to as tall a six feet six inches or more can be simulated.

Frame 52 is secured in place by base 50. Base 50 includes weighted foundation 60 and anchoring portion 62 which hold anchoring mechanisms 64 and 66. In the preferred embodiment, anchoring mechanisms 64 and 66 are apertures into which frame 52 is inserted. Anchoring mechanism 64, into which frame 52 is inserted in FIG. 4, is an aperture formed at an angle such that when frame 52 is inserted, mannequin 10 is angled forward to simulate elevated firing positions. Mannequin 10 secured to base 50 in this manner allows for the elevated firing positions to be simulated on standard firing ranges.

Referring now to FIG. 5, mannequin 10 is shown again with base 50, and again is supported on frame 52 which is held substantially upright by base 50. In FIG. 5, mannequin 10 is positioned in the vertical position, as opposed to angled forward as in FIG. 4, by placing frame 52 in anchoring mechanism 66 instead of anchoring mechanism 64. The vertical position shown in FIG. 5 is the standard position for mannequin 10 using base 50. To increase the effectiveness of mannequin 10, mannequin 10 may be rotated into alternate spacial orientations, as opposed to only square to the combatant. Rotating mannequin 10 along the axis of frame 52 allows mannequin 10 to simulate persons at angles to the trainee. These orientations cannot be simulated using standard paper targets.

It is to be understood that although the invention has been described with particular reference to specific embodiments thereof, the form of the invention shown and described in detail is to be taken as the preferred embodiment of same, and that various changes and modifications may be resorted to without departing from the spirit and scope of the invention as defined by the appended claims.

What is claimed:

1. A three dimensional mannequin comprising:

a) an outer shell formed in the shape of a human being, the outer shell formed from a durable flexible material having a durometer rating between about 40 and 65 Shore 'A'; and b) a foam interior inside the outer shell, the foam interior having a density between about 2.8 and 6.5 lbs. per cubic foot.

2. A three dimensional mannequin as described in claim 1 further comprising an internal pole inserted into the foam interior to allow attachment to a base.

3. A three dimensional mannequin as described in claim 1 wherein the foam interior includes a cavity sized and shaped to fit into an existing target system.

4. A three dimensional mannequin as described in claim 1 wherein the outer shell is formed from a polyvinyl chloride material mixed with a plasticizer.

5. A three dimensional torso as described in claim 4 wherein the plasticizer is about 75 to 160 parts per hundred by weight.

6. A three dimensional mannequin as described in claim 1 wherein the foam interior is formed from flexible polyurethane having a density from about 2.8 to 6.5 lbs. per cubic foot.

7. A three dimensional mannequin as described in claim 1 wherein the outer shell is formed in the shape of a human torso and head.

8. A three dimensional mannequin comprising:

a) an outer shell made from a flexible material with a durometer rating between about 40 and 65 Shore 'A', such that the flexible material substantially returns to an original position after allowing a projectile to pass therethrough; and b) a foam interior inside the outer shell to support the outer shell in its desired shape, the foam interior also allowing the projectile to pass therethrough without serious change in its structure or shape.

9. A three dimensional mannequin as described in claim 8 wherein the flexible material is a polyvinyl chloride and plasticizer mixture having an elongation percentage between 200 and 300.

10. A three dimensional mannequin as described in claim 9 wherein the mixture contains between 9 and 10 lbs. of plasticizer per gallon of polyvinyl chloride.

11. A three dimensional mannequin as described in claim 8 further comprising an internal pole.

12. A three dimensional mannequin as described in claim 11 wherein the internal pole is a medium density polyethylene material.

13. A three dimensional mannequin as described in claim 8 wherein the foam interior is formed by a flexible polyurethane foam with a density between 2.8 and 6.5 lbs. per cubic foot.

14. A three dimensional mannequin for marksmanship and weapon practice comprising:

a) an outer shell in the shape of a human torso molded from a mixture of polyvinyl chloride and plasticizer having an elongation percentage between 200 and 300; and b) a foam interior formed from flexible polyurethane having a density between 2.8 and 6.5 lbs. per cubic foot.

15. A three dimensional mannequin as described in claim 14 wherein the outer shell has a Shore 'A' durometer rating between 40 and 65.

16. A three dimensional mannequin as described in claim 14 wherein the mixture is 30% to 60% plasticizer by volume.

17. A three dimensional mannequin as described in claim 14 wherein the mixture is made up of between 9 and 10 lbs. of plasticizer per gallon of polyvinyl chloride.

18. A three dimensional mannequin as described in claim 14 further comprising an internal pole which extends from a base of the mannequin.

19. A three dimensional mannequin as described in claim 18 further comprising a stand, the stand receiving the internal pole.

* * * * *